US010648646B2

(12) United States Patent
Bruchhage et al.

(10) Patent No.: US 10,648,646 B2
(45) Date of Patent: May 12, 2020

(54) MONOREFLECTOR OPERATING ROOM LIGHT

(71) Applicant: TRILUX Medical GmbH & Co. KG, Arnsberg (DE)

(72) Inventors: Markus Bruchhage, Arnsberg (DE); Dominik Körling, Arnsberg (DE); Hermann Hauschulte, Arnsberg (DE)

(73) Assignee: TRILUX Medical GmbH & Co. KG, Arnsberg (DE)

( * ) Notice: Subject to any disclaimer, the term of this patent is extended or adjusted under 35 U.S.C. 154(b) by 132 days.

(21) Appl. No.: 15/806,579

(22) Filed: Nov. 8, 2017

(65) Prior Publication Data

US 2018/0135834 A1 May 17, 2018

(30) Foreign Application Priority Data

Nov. 11, 2016 (DE) ..... 10 2016 121 689

(51) Int. Cl.
*F21V 13/04* (2006.01)
*F21V 7/00* (2006.01)
(Continued)

(52) U.S. Cl.
CPC ..... *F21V 13/04* (2013.01); *F21V 3/061* (2018.02); *F21V 5/007* (2013.01); *F21V 7/0008* (2013.01);
(Continued)

(58) Field of Classification Search
CPC ..... F21V 13/04; F21V 5/007; F21V 7/0008; F21V 7/0033
See application file for complete search history.

(56) References Cited

U.S. PATENT DOCUMENTS 2,798,938 A * 7/1957 Jewell ..... F21V 21/14 362/401
4,037,096 A * 7/1977 Brendgord ..... F21V 7/0008 362/294
(Continued)

FOREIGN PATENT DOCUMENTS

CN 104100878 A 10/2014
DE 2535556 A1 2/1976
(Continued)

OTHER PUBLICATIONS

Search Report dated Jan. 26, 2018 in EP 17 20 0537.3.

*Primary Examiner* — Jong-Suk (James) Lee
*Assistant Examiner* — Christopher E Dunay
(74) *Attorney, Agent, or Firm* — Panitch Schwarze Belisario & Nadel LLP

(57) ABSTRACT

Operating room monoreflector light includes a dome or hood-shaped upper housing portion and a lighting means arranged in the upper housing portion, preferably as an LED lighting means, including an LED board on which a plurality of LEDs are arranged. A main reflector is arranged in the upper housing portion and deflects a light flux produced by the lighting means through a light exit opening closed by a cover plate of the upper housing portion. To reduce the necessary installation space and to simplify the construction, the upper housing portion is in one piece and extends interruption-free from an upper end which is directed upwardly in the installation position to a lower end which defines the light exit opening. The upper housing portion includes a fixing plane for the LED board, and on which an LED light module is or can be mounted.

10 Claims, 6 Drawing Sheets

(51) Int. Cl.

| | |
|---|---|
| ***F21V 29/89*** | (2015.01) |
| ***F21V 3/06*** | (2018.01) |
| ***F21V 5/00*** | (2018.01) |
| ***F21V 7/04*** | (2006.01) |
| ***F21V 7/06*** | (2006.01) |
| ***F21V 14/04*** | (2006.01) |
| ***F21V 17/12*** | (2006.01) |
| ***F21V 19/00*** | (2006.01) |
| *F21Y 115/10* | (2016.01) |
| *F21W 131/205* | (2006.01) |

(52) U.S. Cl.
CPC ..... *F21V 7/0033* (2013.01); *F21V 7/04* (2013.01); *F21V 7/06* (2013.01); *F21V 14/04* (2013.01); *F21V 17/12* (2013.01); *F21V 19/0015* (2013.01); *F21V 29/89* (2015.01); *F21W 2131/205* (2013.01); *F21Y 2115/10* (2016.08)

(56) References Cited

U.S. PATENT DOCUMENTS

| | | | | |
|---|---|---|---|---|
| 4,600,979 | A | 7/1986 | Fisher et al. | |
| 4,617,619 | A * | 10/1986 | Gehly | F21V 7/22 362/282 |
| 4,994,945 | A * | 2/1991 | O'Shea | F21V 5/00 362/268 |
| 2002/0172033 | A1 | 11/2002 | Bulko et al. | |
| 2010/0254128 | A1 | 10/2010 | Pickard et al. | |
| 2017/0365136 | A1* | 12/2017 | Torre Sarmiento | B60Q 1/2611 |
| 2018/0135834 | A1* | 5/2018 | Bruchhage | F21V 29/89 |

FOREIGN PATENT DOCUMENTS

| | | | |
|---|---|---|---|
| DE | 102007042646 | A1 | 3/2009 |
| DE | 102009012138 | A1 | 9/2010 |
| DE | 102012201706 | A1 | 8/2012 |
| DE | 202013006570 | U1 | 8/2013 |
| WO | 198700603 | A1 | 1/1987 |
| WO | 2013000639 | A2 | 1/2013 |

* cited by examiner

MONOREFLECTOR OPERATING ROOM LIGHT

BACKGROUND OF THE INVENTION

The invention concerns a monoreflector operating room light (OR-light) including an at least portion-wise dome-shaped or hood-shaped or bowl-shaped upper housing portion which has a housing top side directed upwardly in the installation position and a downwardly directed housing inside and which is preferably in the form of an aluminium die casting, an LED lighting means arranged at the inside on the housing inside of the upper housing portion for producing a light flux which radiates in a primary light direction and which is incident on a deflection reflector arranged in front of the LED lighting means in a radiation direction and in turn directing the light flux back on to a main reflector which is arranged in the upper housing portion and which deflects the light flux through a light exit opening of the upper housing portion, that is closed with a cover plate, for illumination of a visual task.

State of the Art

Monoreflector OR lights including a centrally arranged lighting means with an optical system arranged in front of same in the radiation direction, in contrast to so-called multi-field lights with a plurality of light fields which are disposed around a central holder and are fixed pivotably to that holder for focusing purposes, afford improved depth illumination of a wound during the operation and in that respect require less re-adjustment than multi-field lights.

Such a monoreflector light has the advantage of a particularly high level of depth illumination, that is to say a relatively high range around the area of maximum luminance, in which at least 60 percent of that maximum luminance is achieved, in order in an operation to be able to illuminate the wound without loss of light and re-adjustment or focusing.

The monoreflector operating room lights known from the state of the art include a dome-shaped or bowl-shaped upper housing portion, at the inside of which at the upper apex point is fitted a holding flange to which a light module which enlarges conically in the radiation direction is fixed, which is accommodated in the upper housing portion and extends from the upper end to the lower end. That light module includes fixed directly to the holding flange which functions as a heat sink, an LED board having a plurality of LEDs arranged in a grid configuration and a module housing which extends around that LED board and which enlarges conically downwardly in the radiation direction and which is in the form of a hollow pyramid, with a plurality of reflectors arranged at the inner peripheral surface thereof. Arranged at the lower end of the OR light is a saddle-shaped or pointedly tapering deflection reflector which deflects the directly incident light flux laterally upwardly on to the main reflector surrounding the light module and from same through the light exit opening and the cover plate on to the visual task.

Such a light module is for example the ITOS SL-Module from OSRAM. Such a light module represents a complete integral module which in the surrounding housing at the upper end thereof includes the LED board and a plurality of reflectors. At the same time this substantially determines the structural height of the OR light because the monoreflector OR light has to be at least as large as the longitudinal direction of the module housing in order to be able to accommodate it. In regard to assembling such monoreflector lights, firstly individual units have to be pre-assembled and those units then have to be finally fitted to the OR light. In that case the units have to be handled and turned round a plurality of times. A first unit is the bottom glass ring which is disposed at the bottom in the installation position, with the glass plate which closes the light exit opening, and the main reflector which is substantially in the form of a parabolic ring segment, with an opening at the top side for fitment of the light module therein. A second unit constitutes the upper housing portion, also referred to as the "hood", with the light module fixed thereto at the inside. That light module is fitted into the bowl-shaped upper housing portion which has been turned over, and screwed to the holding flange provided at the inside in the upper housing portion. The upper housing portion together with the light module is then turned through 180 degrees, and fitted from above into the top-side opening of the main reflector which is then fitted on to the bottom glass ring with the fitted cover plate. Finally the upper housing portion the bottom glass ring are screwed together at a joint location and sealed off by way of a seal at the outside.

A monoreflector OR light of the general kind set forth is known from DE 10 2012 201 706 A1 to the present applicant. In addition an LED OR light without a deflection reflector is known from DE 10 2007 042 646 A1 to the present applicant. An LED lighting arrangement is also known from DE 10 2009 012 138 A1. A lamp of a different general kind is also known from US 2010/0254128 A1.

Disadvantages in the State of the Art

The units have to be fitted together in that situation and then the units have to be joined together to constitute the OR light and oriented relative to each other. In that situation the individual units have to be turned round a number of times, which is complicated and time-consuming. In addition the structural height of those known OR lights is governed primarily by the light module which is relatively high so that the lights are relatively large and heavy.

BRIEF SUMMARY OF THE INVENTION

Taking that state of the art as the basic starting point, the object of the invention is to at least partially overcome those disadvantages and in particular to provide a monoreflector OR light which is of a more compact structure and easier to assemble.

Invention

According to the invention in a monoreflector OR light of the kind set forth in the opening part of this specification that object is substantially already achieved in that the upper housing portion is in one piece which extends interruption-free from an upper end to a lower end to form a closed reference system. In that respect the upper housing portion on a housing inside has a fixing plane serving as a reference plane for the components of the optical system. The optical system includes at least one LED board, an optical fitment for light deflection of the light flux produced by the at least one LED board and preferably in addition an aperture member which is substantially in the form of a hollow cylinder and which encloses or surrounds the LED board and the optical fitment at the outside in the installation position. The LED board, the optical fitment and the optional aperture member can be or are mounted on the fixing plane as parts of the optical system. In addition there are provided a plurality of fixing points spaced from the reference plane for further components of the optical system, in particular the main reflector. By virtue of that configuration the upper housing portion forms a reference system which is closed in itself and which guarantees the optically optimal orientation or arrangement of the component parts in the target optical position upon assembly. Advantageous developments are recited in the appendant claims.

The reference system is thus formed by the fixing plane which forms the zero point or reference point of the reference system, and a plurality of fixing points spaced therefrom for component parts of the optical system, in which respect naturally component parts of the optical system, which are built up upon each other, can also be fixed on the fixing plane, like the LED board, an optical fitment and an aperture member which preferably encloses those first two components.

This design configuration according to the invention has crucial advantages. On the one hand, a module housing is no longer needed so that the space required for same and in particular the height of the light is no longer required, and that enhances the design flexibility, both from technical points of view and also in regard to aesthetic aspects. Thus the structural height of the OR light according to the invention can be reduced by about a quarter to a third in comparison with existing monoreflector OR lights. More specifically the above-mentioned ITOS module known from the state of the art requires mirrors arranged laterally on the module housing as reflection surfaces for focusing the light in the desired direction, however the pre-defined structural height is substantially governed by the housing of the module. According to the invention that housing is no longer necessary because the collimator lenses focus the light emitted by the LEDs in the main beam direction.

Therefore the design configuration according to the invention markedly simplifies assembly of the light. More specifically, for assembly purposes, only the one-piece, preferably bowl-shaped light housing has to be placed on a support, with the light housing top side facing downwardly and the light exit opening directed upwardly. Then all necessary components can be fixed at the inside, more specifically building them up on the fixing or assembly plane which thus serves as a reference plane for the optical system.

A particular aspect of the invention lies in the configuration of the fixing plane acting as a reference plane for the optical system including the LED board, the optical fitment and preferably the aperture member, and additionally also the deflection reflector, the main reflector and the cover plate, which thus simplifies assembly and alignment relative to each other to achieve an optimised optical system and which is only possible by virtue of the one-piece configuration according to the invention of the housing, because a number of housing portions besides the optical systems do not have to be fitted together and aligned.

For the aperture member and/or the main reflector however it is also possible to provide other fixing means suitably spaced from the fixing plane. Fixing domes or supports for supporting the cover plate are further preferably provided, which can also be formed by way of an outer edge of the upper housing portion, that is arranged displaced relative to the light exit plane and can be designed for mounting the main reflector. In the preferred situation those fixing domes therefore extend beyond a plane defined by the outer edge of the upper housing portion. These fixing domes preferably comprise mounting or bearing surfaces as part of the reference system for mounting the main reflector.

Those fixing domes can include receiving means for receiving or fixing the main reflector. Particularly preferably the lower light exit end of the main reflector includes fixing lugs which project outwardly from the outer edge and which fit into the receiving means of the fixing domes and are screwed in position there. Accordingly those receiving means which are preferably displaced downwardly from the fixing plane for the cover plate also form a component part of the optical reference system.

Therefore the upper housing portion extends from its preferably closed upper end to the downwardly open lower end which defines the light exit plane, wherein that lower end can also be formed by fixing domes which project beyond the actual outer edge of the upper housing portion, for support for the cover plate.

If the upper housing portion in the preferred configuration is in the form of a substantially parabolic, bowl-shaped or tub-shaped body with an apex point, that fixing plane is preferably provided at the housing inside in the region of that apex point and thus extends transversely relative to the central vertical axis of rotation or optical axis of the OR light.

The fixing plane is preferably in the form of a cooling surface or is optimised to implement as high a degree of heat dissipation as possible and heat absorption caused thereby by the upper housing portion which also functions as a heat sink. That is effected in particular by the fixing plane not being constituted by a surface which is flat throughout, but by the fixing plane having a plurality of ribs, grooves and recesses which are preferably arranged symmetrically, in particular including a plurality of ring surfaces which enlarge in a ring form from a centre point concentrically outwardly and with their upper edges define the fixing plane, the ring surfaces involving a respective radius which certainly increases from the centre point, and with recesses or free surface portions provided therebetween. The ring surfaces formed in that way can be crossed by legs, for example legs which extend in crossing relationship through the centre point and which cross the concentrically enlarging circular rings. Particularly preferably the fixing plane formed in that way is provided in one piece on the upper housing portion.

In the state of the art more specifically the cover plate and the main reflector were fitted in a bottom glass ring and were therefore frequently not oriented in the optimum fashion relative to the optical system disposed in the upper portion, and in that case had to be aligned in a complicated operation, for which expert operators are required. In the case of the invention in contrast all components are disposed in the upper housing portion and are therefore automatically optically oriented in the optimum fashion by the reference system. In the case of the OR light according to the invention the bottom glass ring only still operates to centre the cover plate, and it is therefore completely independent of the optical system of the OR light.

Preferably the cover plate has an etched surface with a particular gloss level to provide a diffuse light transition effect.

That separation plane between the cover plate and the housing preferably extends in one plane along the outer peripheral edge of the upper housing portion, the edge being arranged downwardly in the installation position, and this also simplifies assembly.

Preferably an optical fitment including at least one collimator lens is arranged in front of the LED board, which focuses the light emitted by the associated LEDs to give the light flux corresponding to the visual task to be performed.

Preferably at least one centering means is provided between the two joint components, that is to say the LED board on the one hand and the optical fitment on the other hand, for further simplifying assembly. The term centering means is used to denote a device which aligns the optical fitment in centred relationship in front of the LED board so that the one or more optical members, in particular in the form of at least one lens, particularly preferably at least one collimator lens, is arranged correctly along the respective optical axis of the associated LED.

In the particularly preferred configuration, besides the centering means, there are also provided position fixing means, that is to say means which besides the centering action also guarantee that the optical fitment is arranged in the correct fitment angle in front of the LED board and fix same so that the at least one lens provided on the optical fitment is oriented along the optical axis of an associated LED.

Those centering and/or position fixing means can either be in the form of additional components or, and this is preferred, they can be provided in one piece on the cooperating joint components (optical fitment and LED board).

It will be appreciated that this is of particular significance when, which is the case with the preferred embodiment, the LED board includes a plurality of individual LEDs which are arranged in a regular pattern on the board and the optical fitment includes a plurality of individual lenses which are associated with the individual LEDs and which therefore in the installation position have to be correctly aligned along the respective optical axis.

Preferably and in a particularly simple configuration the centering and/or position fixing means are in the form of pins engaging into openings on the respective joint components in the installation position.

The structure according to the invention is particularly simple to assemble in that respect because the centering and position fixing means provide that the individual components are of a self-centering nature and thus the individual components of the optical system, that is to say the LED board arranged on the fixing plane, the optical fitment or lens and the aperture member, provide centering means for relative alignment along the optical axis, that is to say for example involving a centering action affording the correct axial alignment and/or angular adjustment, which guarantee the correct angular orientation of the individual components relative to each other upon assembly and/or repair. The upper housing portion thus forms a one-piece continuous reference system whereby particularly slight tolerances will occur in the overall system, but at any event markedly lesser strings of tolerances than in the case of the state of the art having a plurality of housing portions which are fitted together.

Preferably the centering means include a centering pin provided centrally between the LED board and the optical fitment, and the position fixing means include a plurality of positioning pins spaced from same. In the case of an optical fitment having a plurality of lenses those positioning pins provide for the correct placement of the individual lenses above the LEDs associated therewith of the LED board.

Particularly good light deflection in the primary light or main beam direction on to the deflection reflector is implemented by arranging an aperture member around the LED board and the optical fitment disposed in front thereof in the radiation direction (lens or lens arrangement including a plurality of lenses, particularly preferably in the form of at least one collimator lens). Unwanted lateral stray light (light incident on reflecting surfaces in non-defined fashion) is avoided in a particularly desirable fashion by virtue of the fact that the aperture member is non-reflecting at least at the inside. For that purpose the aperture member is preferably made from a black material and in particular is in the form of a plastic injection moulding. According to the invention the aperture member serves not only for light deflection but also for the absorption of stray light insofar as it encloses the LED board and the optical fitment extending around the periphery thereof. That stray light is avoided in particularly desirable fashion by the material being of a rough nature at least at the inside of the aperture member, that faces towards the LED board, whereby diffuse light scattering is achieved. More specifically without that aperture member there is nonetheless the slight possibility of individual light beams issuing into the main reflector, which can cause unwanted light effects in the illumination field produced.

Preferably that aperture member is substantially in the form of a hollow cylinder which encloses the LED board and the optical fitment around the periphery or at the outside thereof in the installation position. Preferably the aperture member is adapted to press the optical fitment on to the LED board in the installation position. That can be preferably effected for example by a step, edge or the like provided at the inside of the aperture member, that is geometrically adapted to provide contact against an outer edge of the collimator lens so that the aperture member with that step bears at the top side against the outer edge of the collimator lens and thus presses it against the LED board.

That aperture member directs the light flux produced along the optical axis in the main beam direction without the formation of stray light on to the deflection reflector arranged in front thereof in the beam direction in the cover plate. That reflector is preferably adjustable in height by way of a focusing unit, for example including a linear drive. That light is deflected upwardly again by that deflection reflector, that is to say in opposite relationship to the main beam direction on to the main reflector which extends in a ring shape around the central vertical axis or main beam direction and which is accommodated in the upper housing portion.

That main reflector has a reflector surface which is adapted to the situation of use involved and the visual task to be performed and preferably has a plurality of individual reflector surfaces. A structure which has proven to be particularly desirable is a facette structure which is preferably distributed regularly at the surface of the main reflector and which can also be of a differing configuration in respect of the zones involved. Depending on the visual task to be performed, a possibility is the combination of zonally differing curvature regions and/or individual reflection surfaces, that is to say individual reflection surfaces which are delimited by a surrounding edge and involve a respective defined curvature, wherein they preferably directly adjoin each other and thus form a kind of continuous honeycomb structure. Another possibility is the combination of a honeycomb structure with individual reflection surfaces which adjoin each other directly or at a spacing, with different reflection regions of a geometrical configuration, for example a ring structure and/or a wave structure with ring portions which are enlarged concentrically on the main reflector.

In the case of the invention therefore the at least one LED board which is fixed on the mounting plane, the optical fitment arranged in front thereof in the radiation direction, and the aperture member which preferably encloses those two components, form the LED module which can be adapted and designed on a completely individual customer basis and which, involving a structural height of 50 to 100 mm, in particular 68 mm, is of a substantially smaller height than existing LED modules.

A further simplification in terms of assembly can be achieved if provided between the upper housing portion and the main reflector is a position fixing means which permits both axial and/or rotational arrangement in relation to each other in precise alignment in respect of the main reflector relative to the mounting plane with the LED module and the housing. Preferably the position fixing means include projections engaging into corresponding grooves. Particularly preferably projections are provided at the radial outer edge of the main reflector, which can be fitted into recesses in the hood or upper housing portion.

A further simplification in assembly can be achieved if there is provided between the upper housing portion and the bottom glass ring holding the cover disc, an adjustment means which operates upon assembly, preferably including inclined fitment surfaces which act in mutually complementary fashion and which slide against each other upon assembly or only with the respective counterpart surface, and thus after rotation of the fixing means, provide a press fit between the joint components. In addition those joint components can provide for positional fixing for the cover plate in order therefore to position it precisely centrally and hold it at its periphery.

According to the invention, to close the OR light, only the bottom glass ring still has to be screwed to the upper housing portion, more specifically after all other components including the cover plate are fitted in or on the upper housing portion serving as the reference system. In the assembly procedure therefore the cover plate is also oriented in relation to the reference system and is only still fixed in the target position by the bottom glass ring. That is a further decisive advantage in terms of simplifying the assembly of all components in the reference system which is formed by the upper housing portion and which is built up on the assembly planes functioning as the reference plane, in such a way that all components can be arranged only in the target optical position. Because faults in assembly are thus out of the question, assembly can also be carried out by untrained staff.

For simple positioning in the target optical position and for position fixing purposes, the main reflector preferably has at least one position fixing means, particularly preferably including laterally projecting lugs which are referenced in terms of height in relation to the assembly plane of the upper housing portion. To accommodate those lugs the upper housing portion has recesses or receiving means which are spaced in defined relationship from the assembly plane, for accommodating the lugs in the installation position.

In the monoreflector OR light according to the invention the cover plate which closes the light exit opening is also held by a bottom glass ring which embraces the outer edge of the cover plate at the lower side in the installation position. To provide for that engagement the bottom glass ring preferably has a support or holding flange which forms a support surface for the cover plate and from which an outer edge extends upwardly transversely relative to the plane of that support surface, which outer edge can be connected to the upper housing portion.

In the preferred configuration the bottom glass ring is thus in the form of a lower housing portion which is connected to the upper housing portion at the underside thereof and which with the upper housing portion forms a harmonic unit.

The fact that the bottom glass ring is provided separately from the upper housing portion which alone forms the reference system permits a higher degree of freedom in terms of structural design and decorative design in regard to the configuration of the OR light. The upper housing portion which also functions as a heat sink preferably comprises metal, preferably in the form of an aluminium die casting, to achieve a desired high degree of heat absorption capacity. Such metal bodies have to be removable from a mould in production, which limits the freedom of design in regard to the provision of complex geometries, in particular those involving undercut configurations.

That is particularly important for example if handles are to be provided on the upper housing portion, to carry the main load. Preferably a plurality of handles which are arranged in mutually spaced relationship and with which the OR light can be adjusted are provided at the periphery around the light exit plane or the lower edge of the upper housing portion.

In contrast the bottom glass ring does not have to comprise metal but for example can be of plastic or can consist completely thereof, for example including a PUR foam. That affords particularly broad levels of potential in respect of design and cost.

Preferably provided between the cover plate and the support flange is a seal which particularly preferably is in the form of foamed sealing elements which fit in corresponding receiving grooves, or O-rings. In the particularly preferred embodiment there are provided one or more sealing elements which are spaced relative to each other radially from the central axis of the light. Preferably a tongue-and-groove connection with a further seal is provided at the upper fixing end, which can be connected to the upper housing portion, of the outer edge of the bottom glass ring, so that accordingly the monoreflector OR light has two sealing planes which are arranged in mutually displaced relationship in height, more specifically a first—lower—sealing plane between the cover plate and the support flange of the bottom glass ring and a second—upper—sealing plane at the connection between the outer edge and the upper housing portion. The inwardly disposed sealing surfaces permit particularly simple cleaning of the light in the sterile operating room environment. This sealing system which is accordingly of a multi-stage nature is particularly advantageous for implementing higher levels of protection, in the present case in particular IP54.

Provided at the bottom glass ring, for simplifying assembly or correct fitment of the bottom glass ring on the upper housing portion and correct orientation of the cover plate, there is a position fixing means which in particular includes a plurality of inclined run-on fitment surfaces which are peripherally spaced from each other and against which the outer edge of the cover plate slides in such a way that, when the bottom glass ring is completely fitted on to the upper housing portion, the cover plate is centrally adjusted.

Independently of the monoreflector operating room light (OR light) in itself the invention also concerns a method of particularly efficient and therefore inexpensive assembly of such an operating room light, wherein that assembly operation can be carried out in particular by untrained staff because the light housing according to the invention has a dedicated reference system for optically correct assembly and optically optimal alignment of the components in that reference system, that is to say in the target optical position, which almost completely excludes defective assembly.

That assembly method includes at least the following method steps:

fitting an upper housing portion forming a reference system including a housing top side which is directed upwardly in the installation position but which is directed downwardly in the assembly position and a housing inside which is directed downwardly in the installation position and which is directed upwardly in the assembly position with a fixing plane forming a reference plane on the housing inside, fixing an LED lighting means including at least one LED board having at least one LED for producing a light flux on the reference plane which functions as a reference point of a reference system for an optical system formed by the operating room light, arranging an optical fitment on the lighting means, arranging a main reflector which preferably involves the geometry of a substantially parabolic rotational body in the upper housing portion around the LED board and the optical fitment, and arranging a cover plate with a deflection reflector which is arranged therein and which is adjustable in height by means of a linear drive for focusing the monoreflector operating room light on the light exit plane of the upper housing portion.

In a further method step, prior to fitment of the main reflector, an aperture member can be fixed around the LED board and the optical fitment, preferably also on or at the fixing plane. Alternatively fixing of the LED board, the optical fitment and the aperture member at the fixing plane can be effected in one step.

Finally in a further method step a bottom glass ring can be fixed on the cover plate, which has an edge which in the installation position embraces the cover plate and which preferably completely embraces the cover plate. That bottom glass ring can also have inclined run-on fitment portions which act at the inside against the outer edge of the cover plate for fixing the position of the cover plate in the target position. In addition the bottom glass ring can include sealing means for connection to the upper housing portion, wherein preferably the sealing means is of a two-stage nature, involving therefore a sealing effect in two different planes to achieve higher levels of protection of IP54 and higher.

In the detailed description hereinafter reference is made to the accompanying drawings which form part of this description and which for illustration show specific embodiments with which the invention can be carried into effect. In this respect directional terminology like for example "up", "down", "front", "rear", "forward", "rearward" and so forth are used in relation to the orientation of the respective Figure or Figures being described. As components of embodiments can be positioned in a number of different orientations the directional terminology serves for illustration purposes and is in no way restrictive. It will be appreciated that other embodiments can be used and structural or logical modifications can be implemented without thereby departing from the scope of protection of the present invention. The detailed description hereinafter is not to be interpreted restrictively.

In the context of this description the terms "connected", "joined" and "integrated" are used to describe both a direct and also an indirect connection, a direct or indirect join and a direct or indirect integration. Identical or similar elements are denoted in the Figures with identical references insofar as that is appropriate.

Reference lines are lines joining the reference to the part in question. An arrow in contrast which does not touch a part relates to an entire unit towards which it is directed. The Figures moreover are not necessarily true to scale. Certain regions may possibly be illustrated on a disproportionately large scale to illustrate detail. In addition the drawings can be strikingly simplified and may not contain every detail which is possibly to be found in a practical implementation. The terms "up" and "down" refer to the view in the Figures.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings:

In the Figures:

Figure 1:
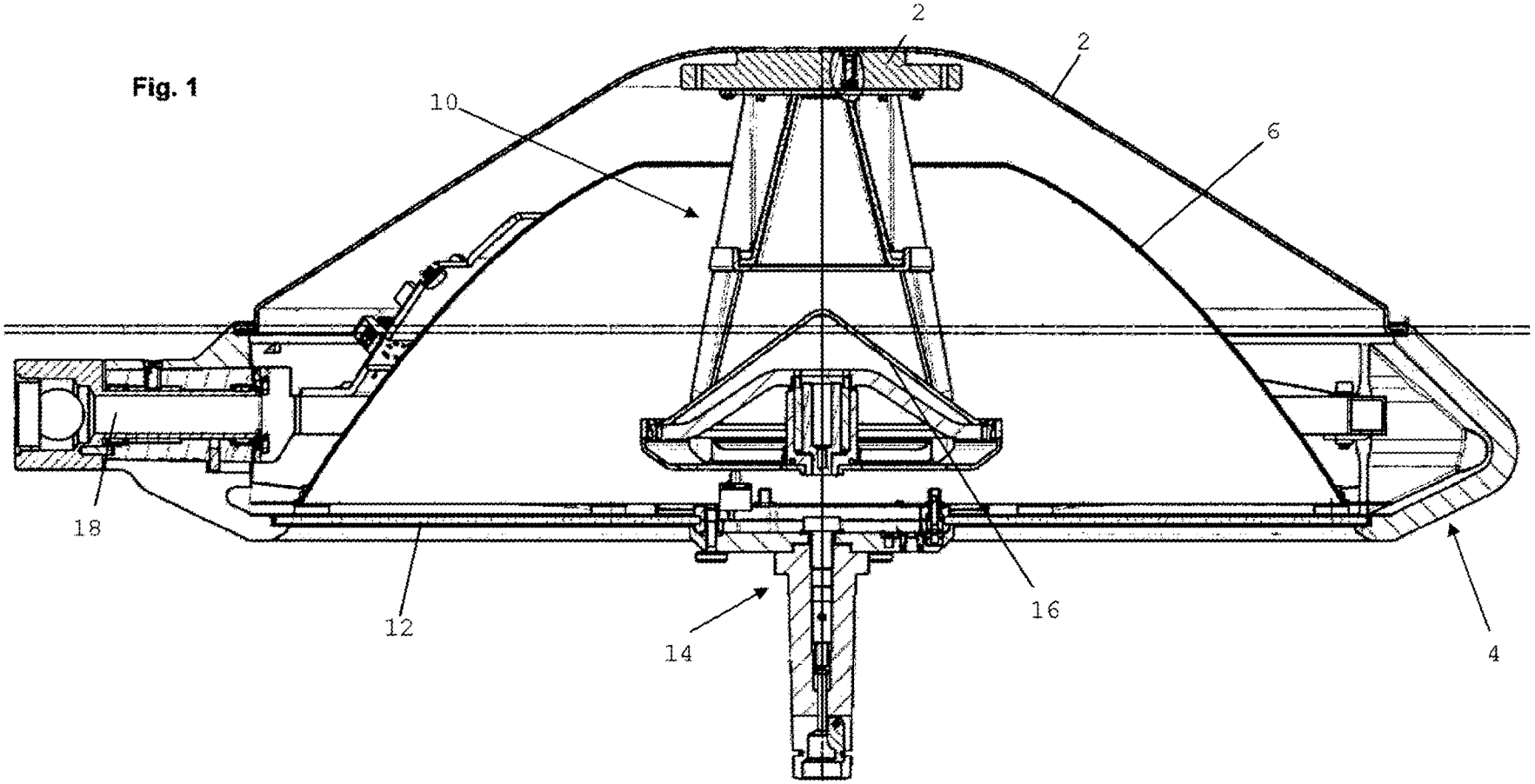
Figure 2:
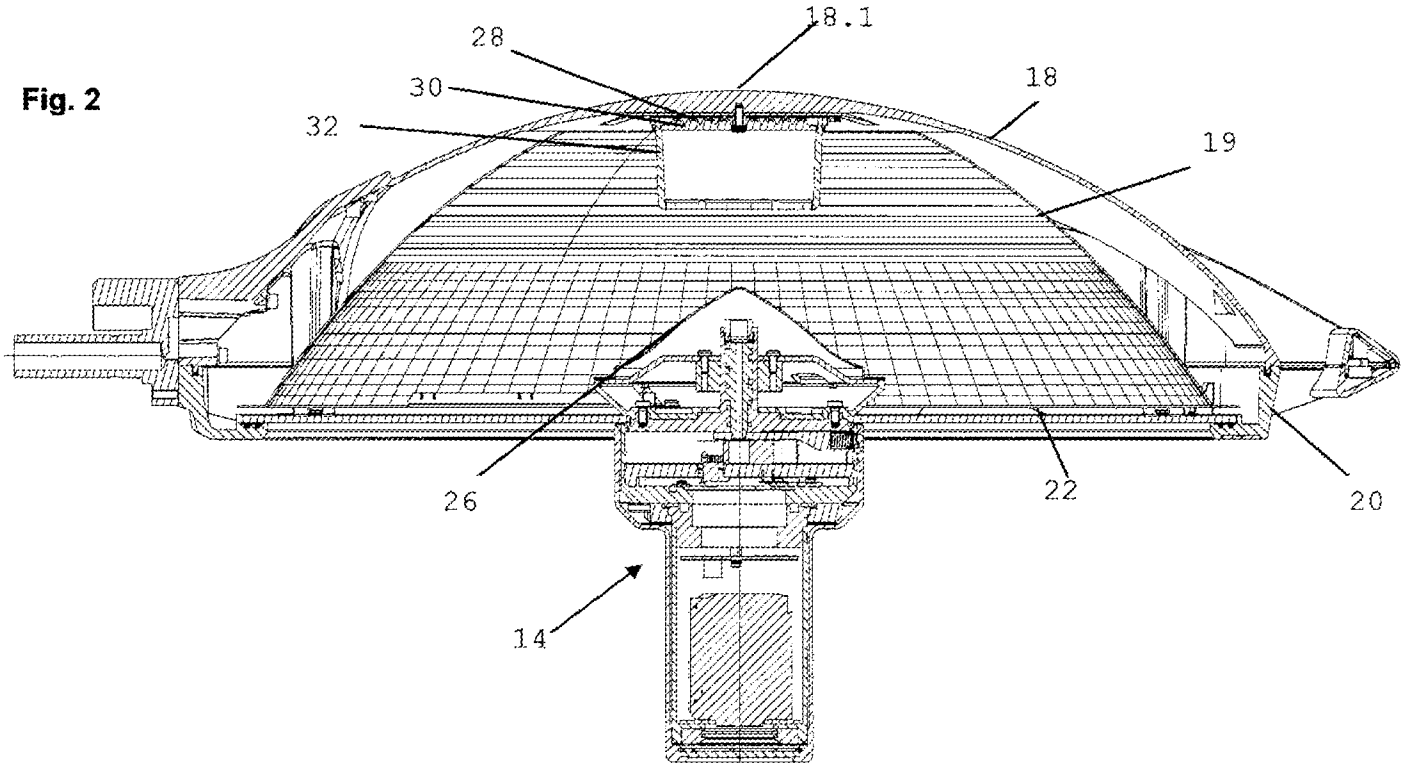
Figure 3:
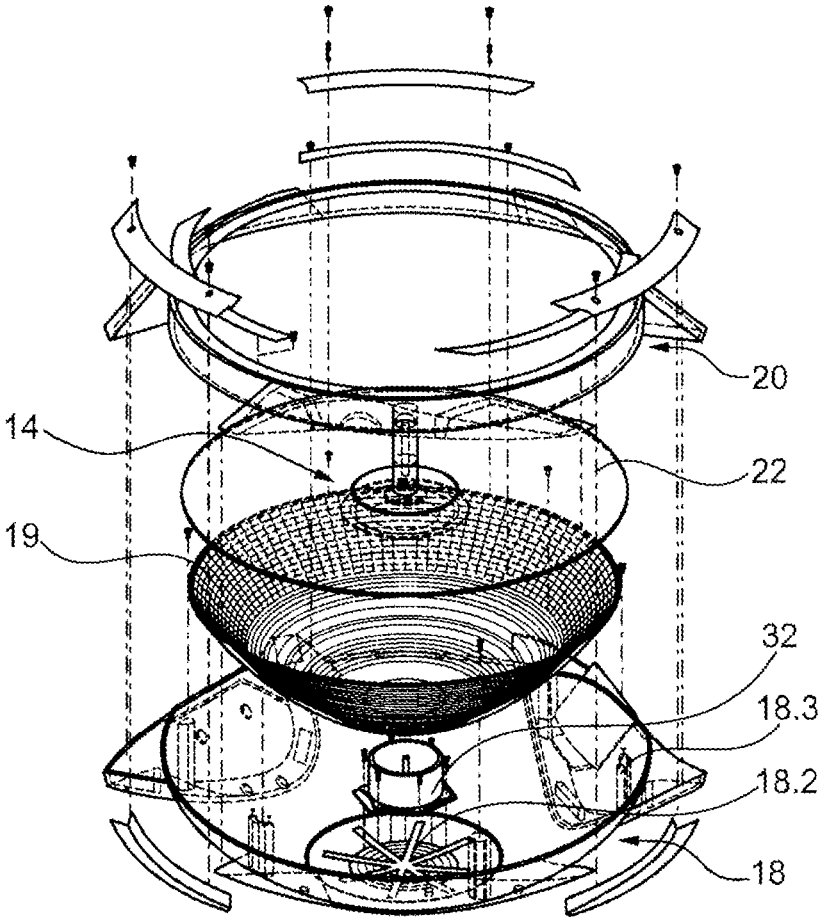
Figure 4:
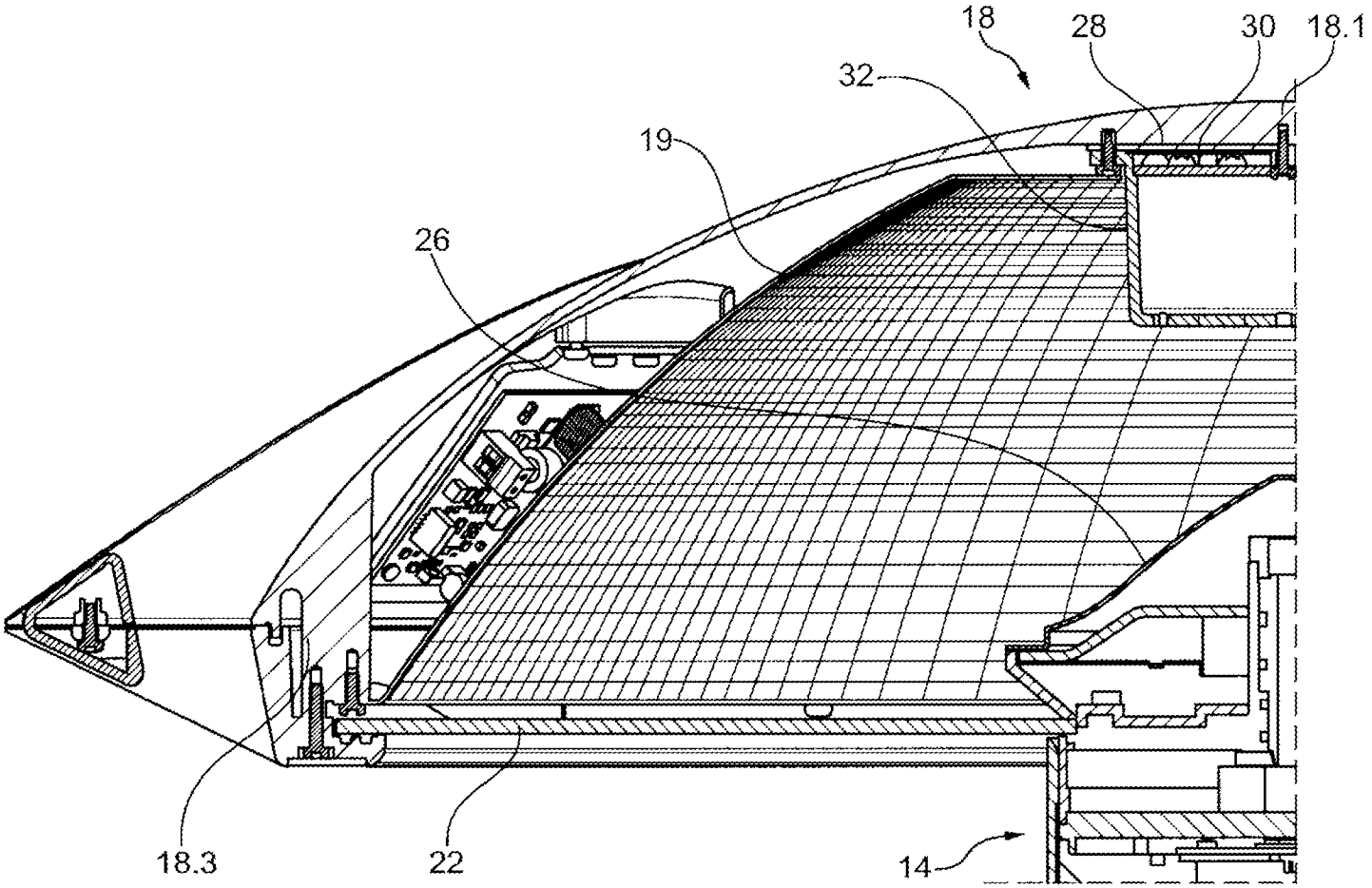
Figure 5:
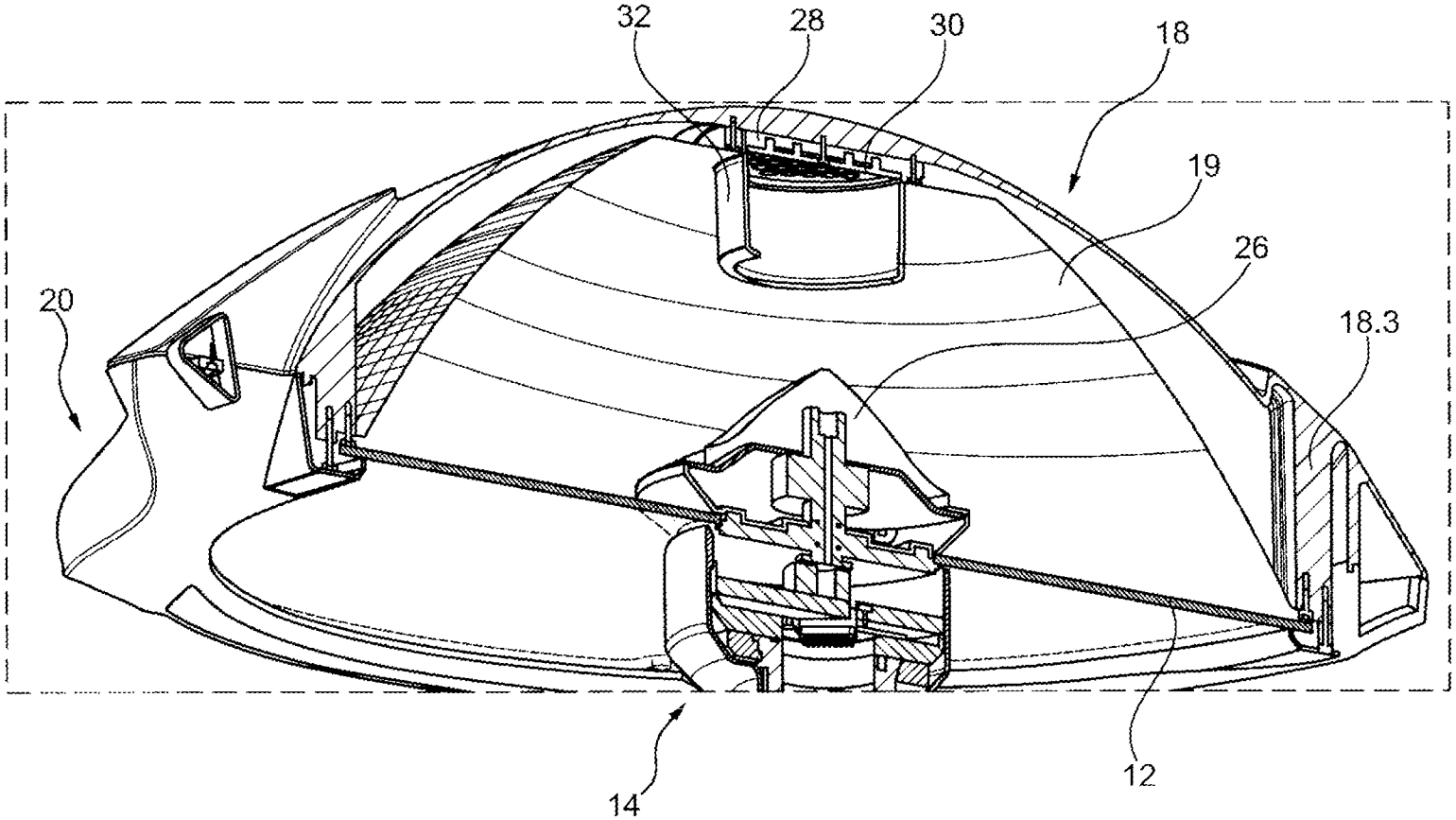
Figure 6:
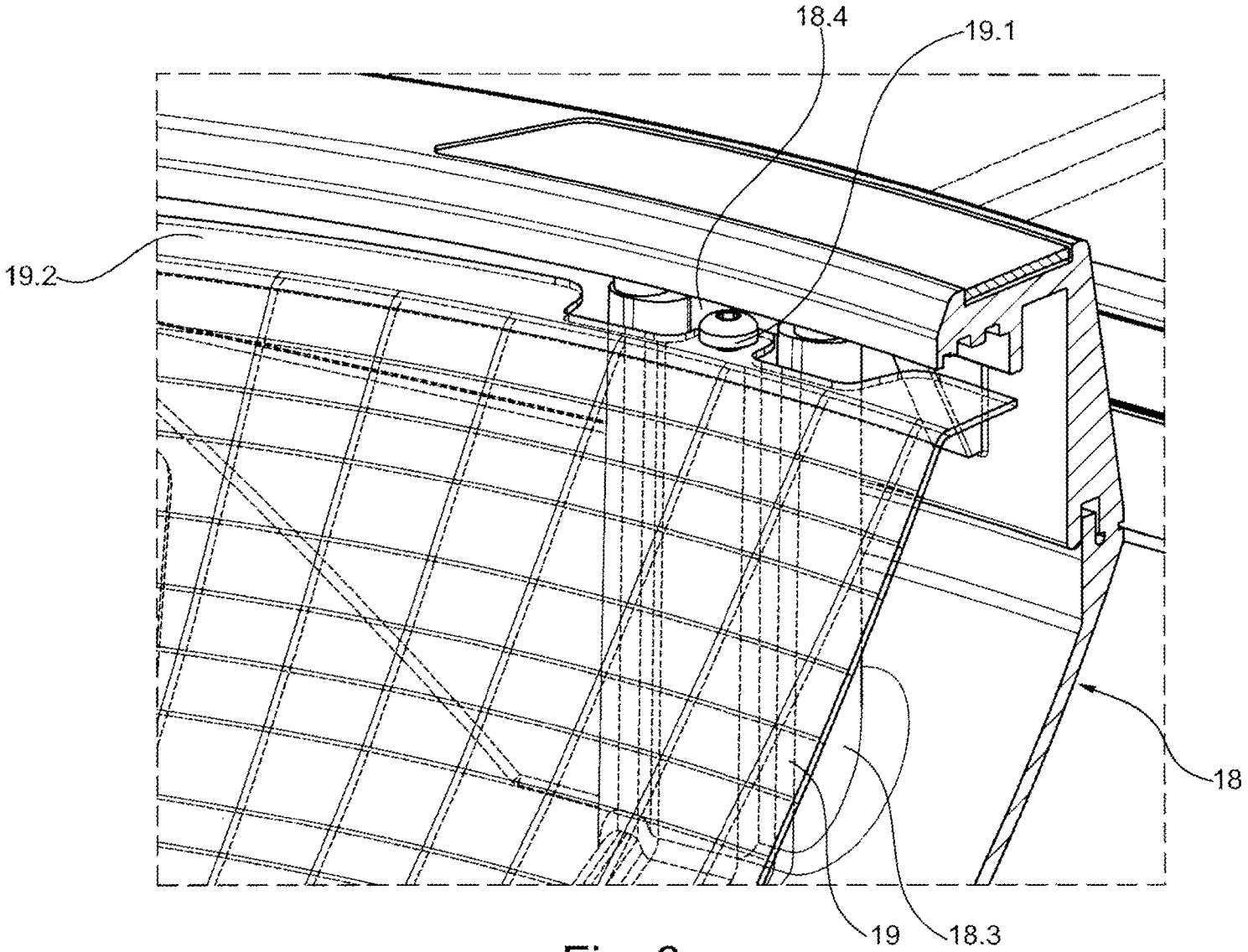

FIG. 1 shows a longitudinal section of a monoreflector OR light according to the state of the art, FIG. 2 shows a longitudinal section of a monoreflector OR light according to the invention, FIG. 3 shows an isometric exploded view of the OR light shown in FIG. 2 in the assembly position to illustrate the procedure involved in the assembly method according to the invention, FIG. 4 shows a view on an enlarged scale of the left-hand half of the OR light shown in FIG. 2, FIG. 5 shows a perspective isometric longitudinal section of the light according to the invention in the position of use with the upper housing portion directed upwardly, and FIG. 6 shows an enlarged detail view of the fixing of the main reflector in the upper housing portion from above, that is to say in the assembly position with the upper housing portion turned over.

DETAILED DESCRIPTION OF THE INVENTION

Accordingly FIG. 1 shows a view in longitudinal section of a monoreflector operating room light known from the state of the art. It substantially comprises an upper housing portion 2, a lower bottom glass ring 4, a substantially parabolic main reflector 6, a light module 10 fixed at a heat sink 8 on the inside of the upper housing portion 2, a cover plate 12 for closing the lower light exit surface and a linear drive 14 arranged in that light exit surface and on the top side of which a roof-shaped or saddle-shaped deflection reflector 16 is arranged adjustably in respect of height. Provided laterally in the bottom glass ring 4 is a push-in coupling 8 with which the operating room light can be fixed to a linkage rod (not shown).

FIG. 2 shows a longitudinal section through a monoreflector OR light according to the invention. This also includes substantially a dish-shaped or bowl-shaped upper housing portion 18, an annular main reflector 19 which extends around the centre with the vertically extending optical axis, a bottom glass ring 20, a cover plate 22 and a deflection reflector 26 which is adjustable in height by way of a linear drive 24 and which is accommodated in the centre of the cover plate 22.

According to the invention the upper housing portion is in the form of a bowl-shaped, one-piece aluminium die casting housing and includes a housing top side with an upper apex point 18.1 from which it extends with a uniform curvature to the light exit surface at which the cover plate 22 is arranged. The linear drive 14 with the deflection reflector 26 which is saddle-shaped or which tapers to a point is fixed in the centre of the cover disk, that is to say aligned with respect to the optical central axis in the main beam direction of the light. Formed at the inside of the upper housing portion 18 beneath the apex point 18.1 and displaced upwardly in parallel relationship with respect to the cover plate 22 is the fixing plane 18.2 according to the invention, on which an LED board 28 with a collimator lens 30 arranged in front thereof the including a plurality of lens associated with the individual LEDs and a hollow-cylindrical aperture member 32 is fixed.

It can be clearly seen that, with the OR light according to the invention, the upper light entry opening of the main reflector 19 virtually directly adjoins the fixing plane 18.2 or is disposed close thereto whereby the reduction according to the invention in structural height by a quarter to a third is particularly apparent in comparison with the state of the art.

The aperture member 32 in the form of a plastic injection moulding of black plastic has at its upper end an inner step which in the installation position bears against the outer edge of the collimator lens 30 and the LED board 28 and jointly extends around same at the outside thereof, where the aperture member is screwed or latched to the fixing plane 18.2.

FIG. 3 shows the OR light upon assembly, that is to say in the assembly position, wherein therefore the bowl-shaped upper housing portion 18 is arranged on a surface (not shown), in a holder or the like, with the top side of the upper housing portion 18 facing downwardly, and then the individual components are fitted into the upper housing portion 18, building up on the fixing plane 18.2 serving as the reference plane, in which case the LED board 28 and the collimator lens 30 are already mounted on the fixing plane 18.2. In the assembly procedure firstly the aperture member 32 including the LED board 28 and the collimator lens 30 is screwed on the fixing plane 18.2, then the main reflector 19 is fitted and inserted with six outwardly projecting assembly lugs 19.1 which are spaced uniformly from each other on a circle and which in FIG. 3 are directed upwardly but which in the installation position are arranged downwardly, in receiving means 18.4 which are provided on a total of six fixing domes 18.3 which are uniformly spaced from each other on a circle at the inside of the upper housing portion and which extend to the light exit opening, and they are screwed to those fixing domes 18.3. One of those fixing domes 18.3 is shown on an enlarged scale in FIG. 6. It can be clearly seen that this centrally includes the receiving means 18.4 which is displaced downwardly from the plane of the light exit surface, that is formed by the support for the cover plate 22. To increase stability the main reflector 19 has a peripherally extending outer flange 19.2 and includes recesses so that same can be fitted on to the fixing domes 18.3.

It is possible to see in FIG. 6 one of a plurality of the inclined run-on fitment surfaces 22.1 of the bottom glass ring 22, having a joining surface which rises in the fitment direction, that is to say being of a conical configuration, and which in the installation position presses at the outside against the outer edge of the cover plate 22 and thus fixes it in position. Of those portions 22.1 a plurality are integrally shaped on the inside of the bottom glass ring 20 at regular spacings from each other.

Adjustment of the light cone produced by the OR light is effected by rotation of the linear drive 14 which is accommodated centrally in the cover plate, whereby the deflection reflector 26 is adjusted upwardly and downwardly. In a further development the rotatable handle may further include a central camera which is enclosed by a rotational sleeve with which an operation can be filmed.

The subject-matter of the present invention arises not just from the subject-matter of the individual claims but from the combination of the individual claims with each other. All details and features disclosed in the documents—including the Abstract—, in particular the spatial configuration shown in the drawings, are claimed as essential to the invention, insofar as they are novel individually or in combination in relation to the state of the art.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A monoreflector operating room light for illuminating a visual task, the light comprising:

an at least portion-wise dome-shaped or hood-shaped upper housing portion (18) having a light exit opening, the upper housing portion (18) being of a one-piece construction and extending interruption-free from an upper end directed upwardly in the installation position to a lower end defining the light exit opening for forming a reference system which is closed in itself, the upper housing portion (18) further including an outermost radial edge;

an optical system including:

at least one LED board (28) for producing a light flux radiating along an optical axis in a radiation direction, an optical fitment (30), and a deflection reflector (26) and a main reflector (10) arranged in front of the at least one LED board (28) in the radiation direction, the deflection reflector being adjustable and having a primary reflection surface in order to reflect the light flux on to the main reflector, which is also arranged in the upper housing portion, and then deflects the light flux through the light exit opening of the upper housing portion (18);

a cover plate (22) closing the light exit opening of the upper housing portion;

a fixing plane (18.2) on an inside of the upper housing portion (18), the LED board (28) and the optical fitment (30) being mounted on the fixing plane (18.2), which serves as a reference plane for the optical system;

a plurality of fixing points spaced from the reference plane for components of the optical system; and a plurality of fixing domes (18.3) or supports on the upper housing portion that support the cover plate, the fixing domes or supports extending from the upper housing portion in the radiation direction beyond a plane defined by the outermost radial edge of the upper housing portion.

2. A monoreflector operating room light according to claim 1 wherein the at least one LED board (28) includes a plurality of LEDs and the optical fitment includes lens associated with each LED.

3. A monoreflector operating room light according to claim 2 wherein provided between the at least one LED board (28) and the optical fitment (30) is at least one centering element and/or at least one position fixing element, with which the at least one LED board (28) and the optical fitment (30) can be connected together in a target optical position.

4. A monoreflector operating room light according to claim 3 wherein the centering and/or the position fixing element includes a pin in a first joint partner and an opening cooperating with said pin the installation position in a second joint partner.

5. A monoreflector operating room light according to claim 1 wherein the optical system includes an aperture member (32) which is substantially in the form of a hollow cylinder and which encloses or surrounds the at least one LED board (28) and the optical fitment (36) on the outside in the installation position.

6. A monoreflector operating room light according to claim 5 wherein the aperture member (32) has an inside facing toward the at least one LED board (28) that is non-reflecting.

7. A monoreflector operating room light according to claim 5 wherein the aperture member is adapted to press the optical fitment on to the at least one LED board in the installation position.

8. A monoreflector operating room light according to claim 7 wherein the aperture member includes an internal step of a complementary configuration to an outer edge of the optical fitment (30).

9. A monoreflector operating room light according to claim 1 wherein the fixing plane (18.1) is in the form of a heat sink.

10. A monoreflector operating room light according to claim 1, further comprising a bottom glass ring connected to the upper housing portion.

* * * * *